US011564479B2

(12) United States Patent
Huang

(10) Patent No.: US 11,564,479 B2
(45) Date of Patent: Jan. 31, 2023

(54) INFLATION SYSTEM AND DEVICE

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 239 days.

(21) Appl. No.: 16/755,548

(22) PCT Filed: Oct. 17, 2017

(86) PCT No.: PCT/CN2017/106523
§ 371 (c)(1),
(2) Date: Apr. 10, 2020

(87) PCT Pub. No.: WO2019/075636
PCT Pub. Date: Apr. 25, 2019

(65) Prior Publication Data

US 2021/0361054 A1 Nov. 25, 2021

(51) Int. Cl.
*A45F 4/06* (2006.01)
*A47C 27/08* (2006.01)
(Continued)

(52) U.S. Cl.
CPC ..... *A45F 4/06* (2013.01); *A47C 27/081* (2013.01); *F04B 33/00* (2013.01); *A45F 2004/026* (2013.01)

(58) Field of Classification Search
CPC .... A45F 4/06; A45F 2004/026; A47C 27/081; F04B 33/00
See application file for complete search history.

(56) References Cited

U.S. PATENT DOCUMENTS 2,423,890 A * 7/1947 Hurt ..... A47C 27/084 52/2.26
2,812,525 A * 11/1957 Friedlander ..... A47C 27/081 417/479

(Continued)

FOREIGN PATENT DOCUMENTS

CN 205597592 9/2016
DE 2616327 10/1977

OTHER PUBLICATIONS

Extended European Search Report dated May 20, 2021 (May 20, 2021) issued on related European Patent Application 17929037.4 by the European Patent Office.

*Primary Examiner* — Craig M Schneider
*Assistant Examiner* — Frederick D Soski
(74) *Attorney, Agent, or Firm* — Dickinson Wright PLLC

(57) ABSTRACT

An inflatable air mattress system comprises an inflatable air mattress defining an air chamber and including an inlet passageway, an inflation valve mounted to the inflatable air mattress, and a connector. The valve defines a passageway that includes a lip and a valve member. The valve member includes a seal movable between a closed position wherein the valve member is at least partially covering the lip. In an open position, inflation air can pass through the passageway and into the air chamber of the mattress. The inflatable air mattress system includes an inflating bladder including an interior portion defined by at least one wall of flexible fabric having a first end and a second end. The first end includes a wide opening securable by a closing spring, the second end includes an outlet adapted to connect to the connector.

4 Claims, 7 Drawing Sheets

(51) Int. Cl.
*F04B 33/00* (2006.01)
*A45F 4/02* (2006.01)

(56) References Cited

U.S. PATENT DOCUMENTS 3,133,696 A * 5/1964 Mirando ..... A47C 27/081 92/92
3,297,241 A * 1/1967 Andreasson ..... A47C 27/081 417/244
3,780,388 A * 12/1973 Thomas ..... A47C 27/087 297/DIG. 3
3,845,795 A * 11/1974 Andreasson ..... F16K 15/20 141/391
4,723,329 A * 2/1988 Vaccaro ..... A47C 27/081 5/725
5,230,611 A 7/1993 Shelton
5,376,113 A * 12/1994 Jansen ..... B29C 41/20 623/2.19
5,437,068 A * 8/1995 Fisher ..... A47C 27/081 5/656
5,482,492 A * 1/1996 Becker ..... A63H 27/10 383/44
5,553,339 A * 9/1996 Thomas ..... A47C 27/081 5/413 AM
5,556,258 A * 9/1996 Lange ..... F04B 33/00 417/63
5,560,056 A * 10/1996 Tai ..... A45F 3/22 5/120
5,709,664 A * 1/1998 Vandenbroek ..... A61B 17/3462 604/167.04
5,806,928 A * 9/1998 Gattuso ..... A47C 27/081 297/284.6
5,855,033 A * 1/1999 Frissen ..... A47C 17/64 5/710
6,775,868 B1 * 8/2004 Mileti ..... A47C 27/001 5/710
7,150,060 B1 * 12/2006 Wu ..... A47C 27/10 5/713
7,331,360 B2 * 2/2008 Camis, Jr. ..... F16K 27/0209 137/512.3
8,141,587 B2 * 3/2012 Doig ..... F16K 15/147 137/846
8,550,067 B2 * 10/2013 Bruce ..... A61M 16/208 128/200.14
8,978,693 B2 * 3/2015 Frayne ..... F16K 15/202 137/513.3
9,517,817 B1 * 12/2016 Scheidler ..... A47C 27/081
10,539,125 B2 * 1/2020 Chang ..... F04B 39/123
10,640,186 B2 * 5/2020 Haynes ..... B64D 25/14
2002/0104162 A1 * 8/2002 Stewart ..... A47G 9/086 5/413 R
2003/0028972 A1 * 2/2003 Michaelis ..... A47C 27/10 5/710
2003/0101516 A1 * 6/2003 Hsu ..... A47C 27/087 5/710
2003/0108699 A1 * 6/2003 Tanaka ..... B65D 81/052 428/35.2
2005/0187524 A1 * 8/2005 Willis ..... A61M 39/26 604/256
2006/0070184 A1 * 4/2006 Lin ..... A47C 27/084 5/689
2006/0118189 A1 * 6/2006 Tekulve ..... F16K 15/148 137/846
2007/0056647 A1 * 3/2007 Frayne ..... B65D 31/145 137/843
2007/0175517 A1 * 8/2007 Wu ..... F16K 15/147 137/231
2008/0047072 A1 * 2/2008 Chang ..... A47C 27/081 5/708
2008/0148488 A1 * 6/2008 Wu ..... A47C 27/081 5/711
2009/0159826 A1 * 6/2009 Poulton ..... F16K 15/147 251/157
2010/0107332 A1 * 5/2010 Brune ..... A47G 9/086 5/413 AM
2010/0186165 A1 * 7/2010 Marciano ..... A47C 17/64 5/419
2010/0299832 A1 * 12/2010 Alford ..... A47G 9/086 5/413 AM
2010/0299842 A1 * 12/2010 Wang ..... A47C 17/82 5/706
2011/0030819 A1 * 2/2011 Chan ..... F04B 33/00 137/511
2011/0297245 A1 * 12/2011 Chaffee ..... F16K 15/1821 137/223
2012/0312388 A1 * 12/2012 Jian ..... B65D 81/052 137/223
2013/0019409 A1 * 1/2013 Blazar ..... A47G 9/1027 5/644
2013/0087228 A1 * 4/2013 Wang ..... F16K 11/048 137/565.12
2013/0180052 A1 * 7/2013 Chen ..... A47C 27/081 5/711
2014/0326558 A1 * 11/2014 Marti ..... A47C 27/082 190/2
2015/0020309 A1 * 1/2015 Pitchforth ..... A47G 9/086 5/413 AM
2015/0362077 A1 * 12/2015 Eells ..... F16K 15/1825 5/710
2016/0186874 A1 * 6/2016 Lin ..... F16K 15/205 137/232
2017/0027334 A1 * 2/2017 Brensinger ..... A47C 27/081
2017/0035636 A1 * 2/2017 Stiff ..... A61G 7/05776
2017/0164760 A1 * 6/2017 Hinnant ..... A47C 27/081

* cited by examiner

INFLATION SYSTEM AND DEVICE

CROSS-REFERENCE TO RELATED APPLICATION

This application is a 35 U.S.C. § 371 national stage application of and which claims priority to PCT Application Ser. No. PCT/CN2017/106523, filed on Oct. 17, 2017, which is hereby incorporated by reference in its entirety.

TECHNICAL FIELD

The present subject matter relates to inflatable beds, and more particularly, to a manually operable pump for filling inflatable beds with air.

BACKGROUND

Often times, inflatable consumer goods, such as pool toys, inflatable mattresses, etc., require that a consumer use lung-power to inflate the product. Alternatively, some inflatables are compatible with a pump. Suitable pumps may be separate from the inflatable or integrated therein. Regardless, pumps take up space, add weight, and require a power source, such as batteries and/or an electrical connection. A separate pump is stored with and/or transported with the inflatable for use therewith, while lung-powered inflatables often require the mouth of the user to be placed on the product. Pumps fill the inflatable quickly and with relative ease for the user, and lung-powered inflation may be slow and tiring for the consumer. A conveniently transportable inflation mechanism that is easily operated by the user represents an improvement in the art.

SUMMARY

According to an aspect of the disclosure, an inflatable air mattress system comprises an inflatable air mattress defining an air chamber and including an inlet passageway, an inflation valve mounted to the inflatable air mattress, and a connector. The valve defines a passageway that includes a lip and a valve member. Further in accordance with this aspect, the valve member includes a seal movable between a closed position wherein the valve member is at least partially covering the lip. When in an open position, inflation air can pass through the passageway and into the air chamber of the mattress. Still further, the inflatable air mattress system includes an inflating bladder including an interior portion defined by at least one wall of flexible fabric having a first end and a second end. The first end includes a wide opening by a closing spring, while the second end includes an outlet adapted to connect to the connector. The inflating bladder is configurable to force a quantity of air from the interior of the inflating bladder, through the connector, and into the air mattress to inflate the mattress.

According to another aspect of the disclosure, a method of inflation includes the steps of coupling a first end of an inflating bladder to an inflatable with a valve connector, opening the second end of the inflating bladder, closing the second end of the inflating bladder to capture air within the inflating bladder, and folding the second end of the inflating bladder towards the valve connector to force air through the valve connector and into the inflatable.

According to yet another aspect of the disclosure, an inflation system includes an inflatable having an interior air chamber and an inflating bladder with first and second ends. Further in accordance with this aspect, the first end of the inflating bladder is detachably coupled with the inflatable, and the second end has an opening for taking air into the inflating bladder. Still further, the system has a closing spring for capturing air within the inflating bladder such that movement of the second end of the inflating bladder towards the first end of the inflating bladder forces air from the inflating bladder into the inflatable.

Further according to aspects of the disclosure, an inflation system includes an inflatable with an air chamber inside same, and an inflation valve mounted to the inflatable. In accordance with this aspect, the valve defines a passageway through which air can pass into the air chamber of the air mattress, and an inflating bladder further includes an interior portion defined by at least one wall of flexible fabric having a first end and a second end. Still further, the inflating bladder has a wide opening at the first end thereof securable by a closing spring, while the second end of the inflating bladder includes an outlet having a connecting tube insertable through the inflation valve of the inflatable so as to open the passageway. Additionally, the inflating bladder is configurable to force a quantity of air from the interior of the inflating bladder, through the inflating bladder connecting tube, and into the air chamber of the inflatable.

Other aspects and advantages of the present invention will become apparent upon consideration of the following detailed description and the attached drawings wherein like numerals designate like structures throughout the specification.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1A:
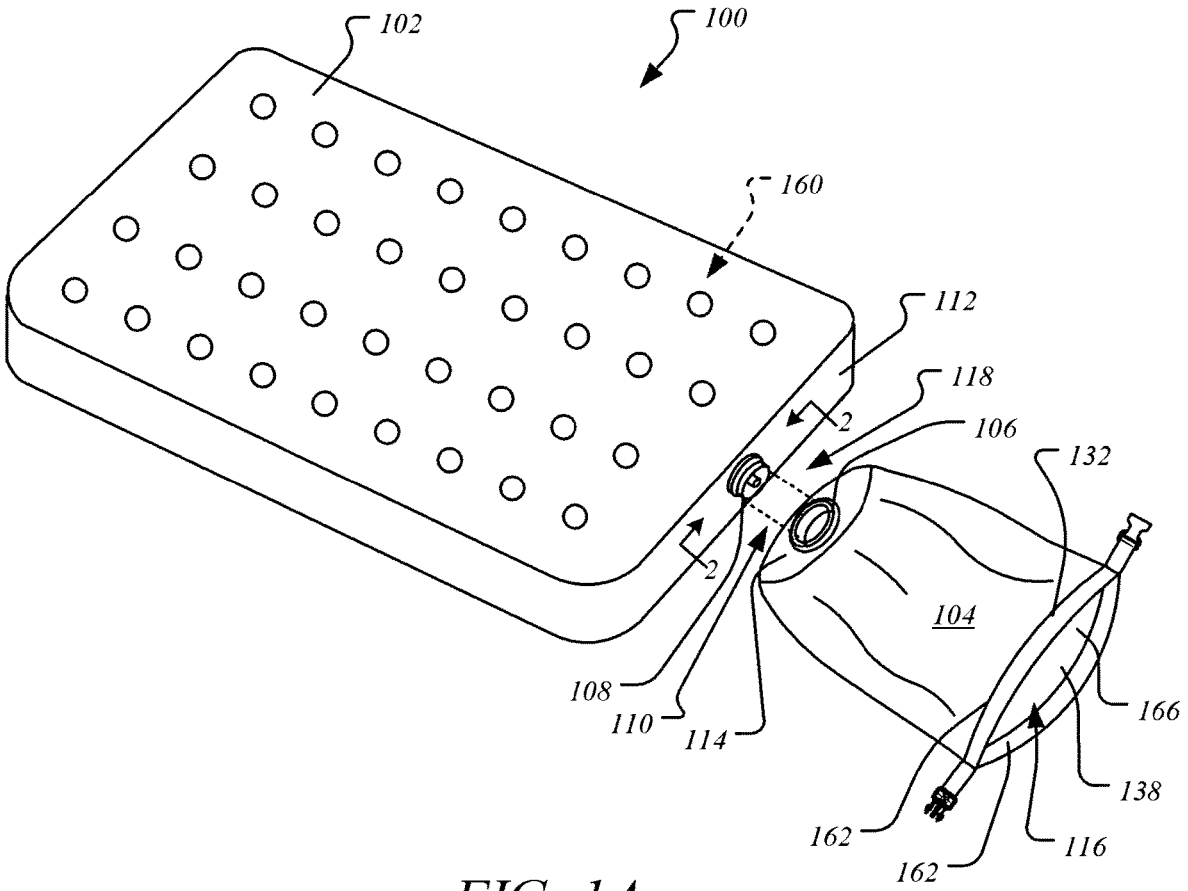
FIG. 1A is an isometric view from above of a system for inflating an inflatable according to example implementations of the present disclosure.
Figure 1B:
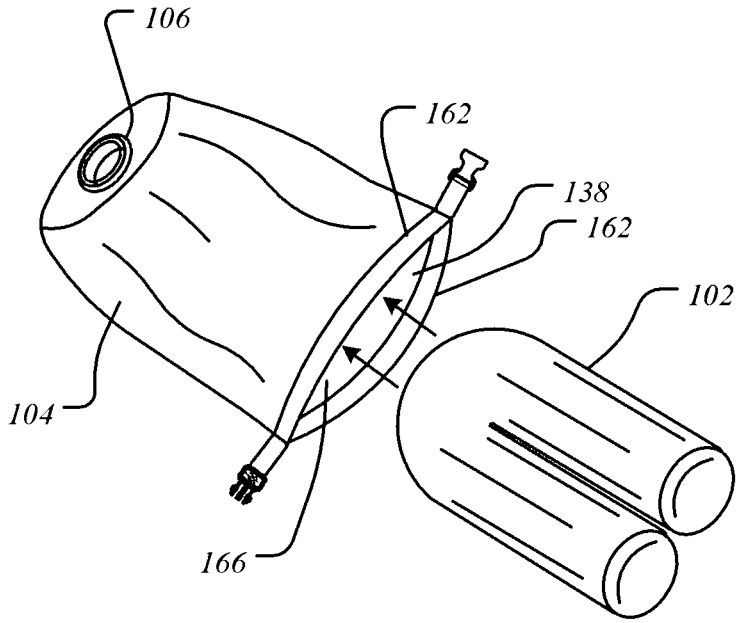
FIG. 1B is an isometric view of the system of FIG. 1A according to an example storage embodiment.
Figure 2:
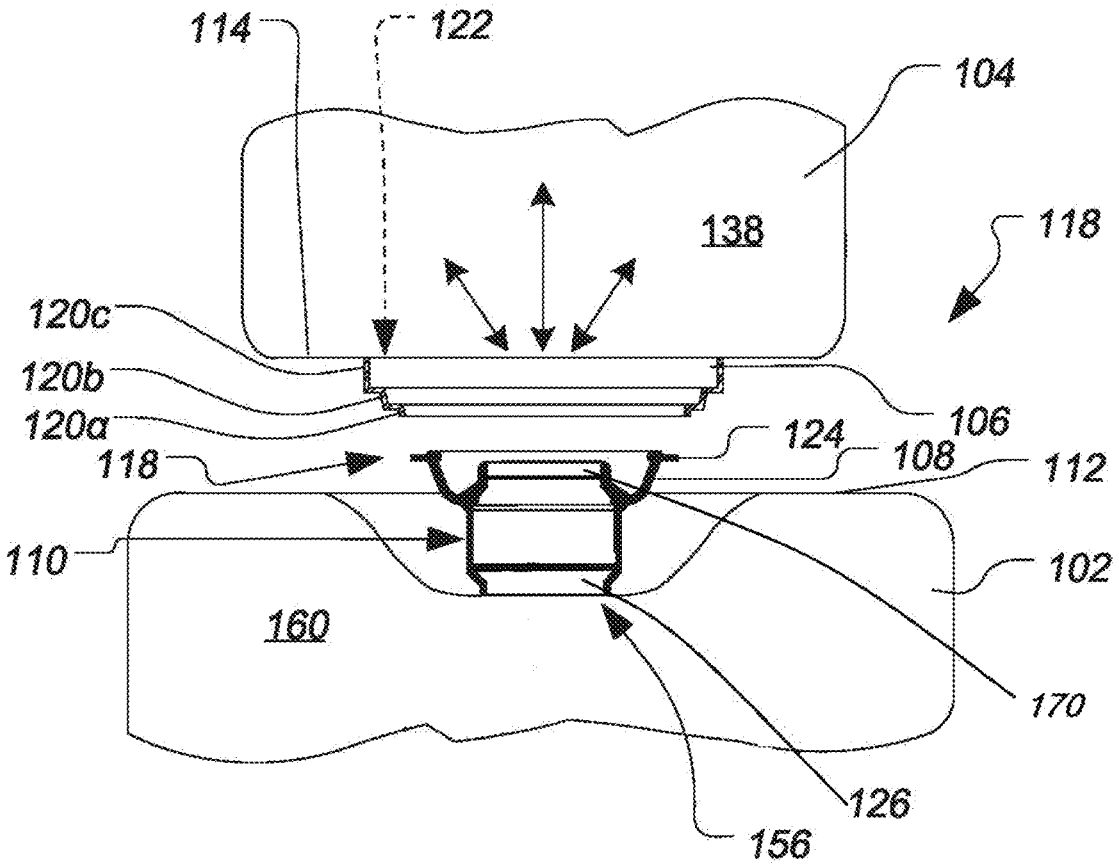
FIG. 2 is an enlarged partial cross-sectional view of a disconnected valve system taken along the line 2-2 as shown in FIG. 1A.

Referring now to FIG. 1A, a system 100 for inflating an inflatable 102, such as an inflatable mattress, with an inflating bladder 104 is depicted. In this example embodiment, male and female connecting portions 106, 108 of a connector 118 are disposed on the inflation bladder 104 and the inflatable 102, respectively. As illustrated in FIGS. 1-3, the female connecting portion 108 is disposed on a side end 112 of the inflatable 102, while the male portion 106 is disposed on an air outlet end 114 of the inflating bladder 104. An air intake end 116 of the inflating bladder 104 is arranged opposite the air outlet end 114. It should be understood that it is within the scope of the present disclosure that the male and female connecting portions 106, 108 may be disposed on the opposite component as compared with the illustrated embodiments, i.e. the male connecting portion 106 may be disposed on the inflatable 102, while the female connecting portion 108 may be disposed on the inflating bladder 104. FIG. 1B depicts the inflating bladder 104 configured as a storage compartment 166 for housing the inflatable 102 during storage and/or transport thereof.

Figure 3A:
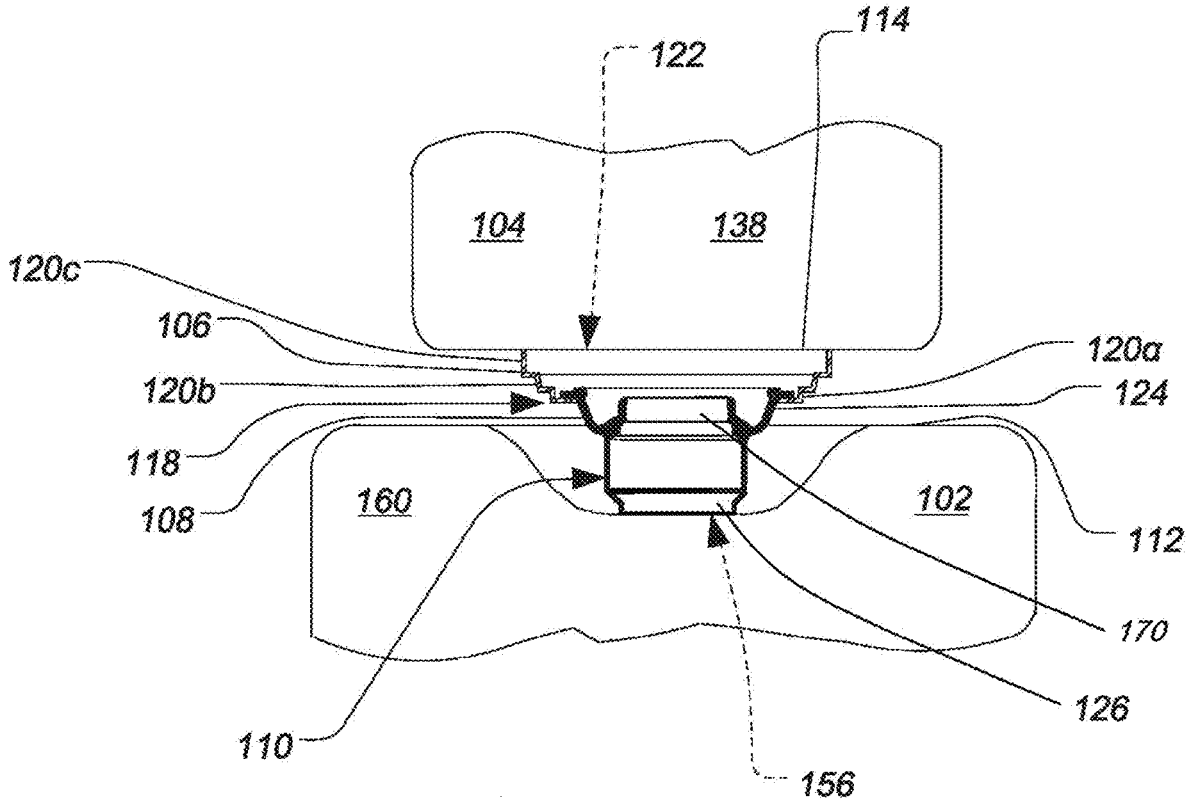
FIG. 3A is an enlarged partial cross-sectional view of an example valve system shown in FIG. 2.

Referring now to FIGS. 2 and 3A, the connector 118 is shown in detail. The male portion and female portions 106, 108 are shaped so as to fixedly couple the inflating bladder 104 and the inflatable 102 during inflation thereof. The male connecting portion 106 has first, second, and third concentric ridges 120*a-c* arranged about a passageway 122 through which air passes upon operation of the inflating bladder 104. The female connecting portion 108 has a resilient flange 124 disposed therein. As illustrated in FIG. 3A, the resilient flange 124 flexes to fit behind the first concentric ridge 120*a* thereby attaching and sealing the male and female connecting portions 106, 108. Furthermore, attachment of the male and female connecting portions 106, 108 operatively couples the inflating bladder 104 with the inflatable 102. The resilient flange 124 presses against the first concentric ridge 120*a* to create a seal between the inflating bladder 104 and the inflatable 102 so that air does not escape through the connection of the male and female connection portions 106, 108. One or more rubber O-rings may be disposed within and/or along the first concentric ridge 120*a* and/or the resilient flange 124.

Example embodiments include threading disposed on the male portion 106 of the connector 118. Complementary threading may be disposed within the female connecting portion 108 such that the male portion 106 may be screwed into the female portion 108 couple the male and female portions 106, 108 of the connector 118. Additionally, one or more rubber washers or seals may be disposed within and/or about the male and female connecting portions 106, 108, together or separated from the threading, so as to aid creation of a seal therebetween and to decrease the amount of air leaked through the connector 118 during the inflation operation described hereinbelow with reference to FIGS. 4 and 5. Alternatively, the male and female connecting portions 106, 108 may be attached to one another by a set of bayonet pins disposed on one of the connecting portions 106, 108 while complementary hole are disposed on the opposite one of the connecting portions 106, 108 for insertion therein. In an example embodiment, a pair of bayonet pins may be disposed on the male connecting portion 106 such that same extend through associate holes in the female connecting portion when the two portions 106, 108 are snapped together. The male and female connecting portions 106, 108 may be formed from relatively hard plastic and/or metal components. The hardened plastic of the connector 118 lends structural integrity and reliability to the inflating system 100. Constructing such components from relatively strong material may provide reliability and durability to the connector 118, even helping to ensure successful operation of the valve system 110 during repeated and heavy usage.

In example embodiments, a one-way inflation valve 126 is configured within the female connecting portion 108. The one way inflation valve 126 may include a valve stem and a spring associated therewith. During operation of the inflating bladder 104 air pressure may cause compression of the spring allowing passage of air through a passageway 156 formed within the inflation valve 126. When air pressure is not present from the exterior of the inflation valve 126, a seal of the inflation valve 126 may occlude the passageway 156 therethrough. However, once air pressure is greater outside the inflatable 102 as compared to within an interior chamber 160 of the inflatable 102, the seal may open the passageway 156 allowing air to pass therethrough and into the interior chamber 160 of the inflatable 102. The valve 126 may be configured as a ball check valve, a tilting disc check valve, a lift-check valve, an in-line check valve, a duckbill valve, a pneumatic non-return valve, or any other suitable valve structure. Also, in the alternative, a valve stem and spring may be depressed to open the valve 126, or the seal may be deformed or pushed away from the passageway 156, via a protrusion extending from the connector 118 of the inflating bladder 104 or by another manual depression technique. For example, a protrusion on the inflating bladder 104 or on a valve stem or any other part of the valve 126 may cause opening of the valve 126 upon connection between the inflating bladder 104 and the inflatable 102. An additional valve 170 may be disposed to block air from escaping the interior chamber 160.

Figure 3B:
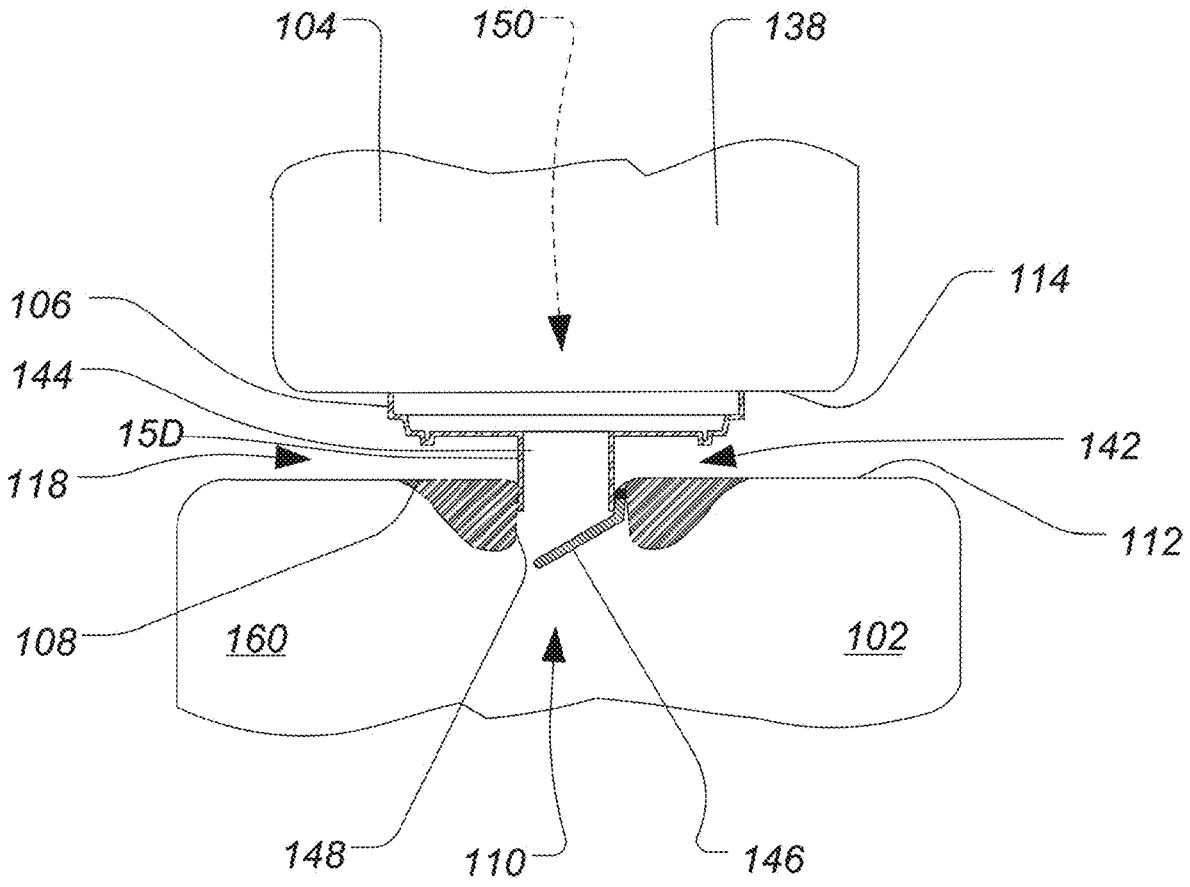
FIG. 3B is an enlarged partial cross-sectional view of another example valve system shown in FIG. 2.

In an example embodiment depicted in FIG. 3B, the one-way valve may be a tilting disc valve 142 and a tube 144 may be inserted through the tilting disc valve 142 to hold open a disc 146 that otherwise is closed against an interior side 148 of the valve 142 by spring power, pressure, or another suitable mechanism or combination of mechanisms. The tube 144 may be integral with the male connecting portion 106 of the inflating bladder 104 or the tube 144 may be a separate component. The tube 144 extends between the inflating bladder 104 and the inflatable 102 providing a passageway 150 for moving air therebetween.

Figure 4:
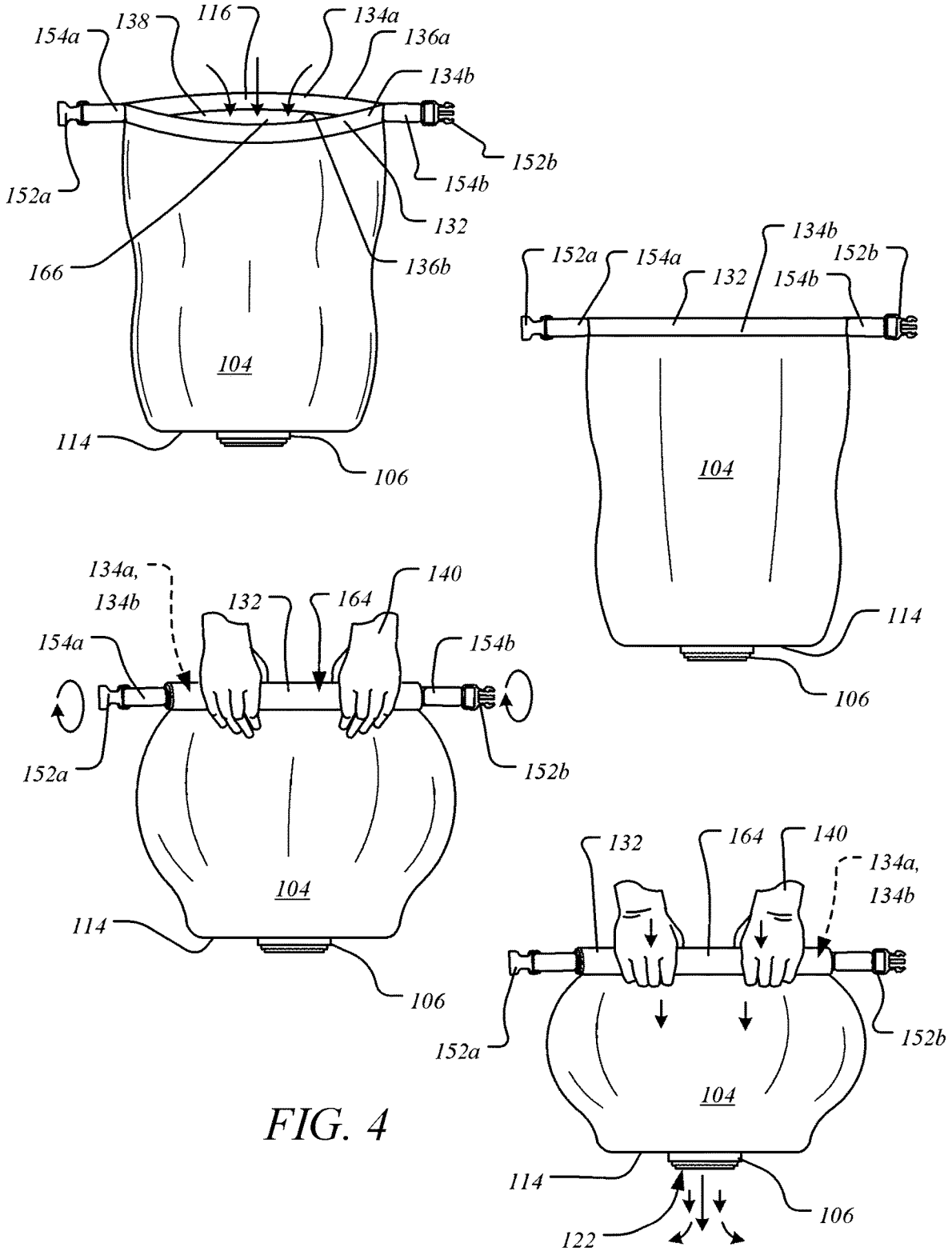
FIG. 4 depicts elevational views of an inflating bladder of the system shown in FIG. 1 in varying steps of operation by a user.
Figure 5:
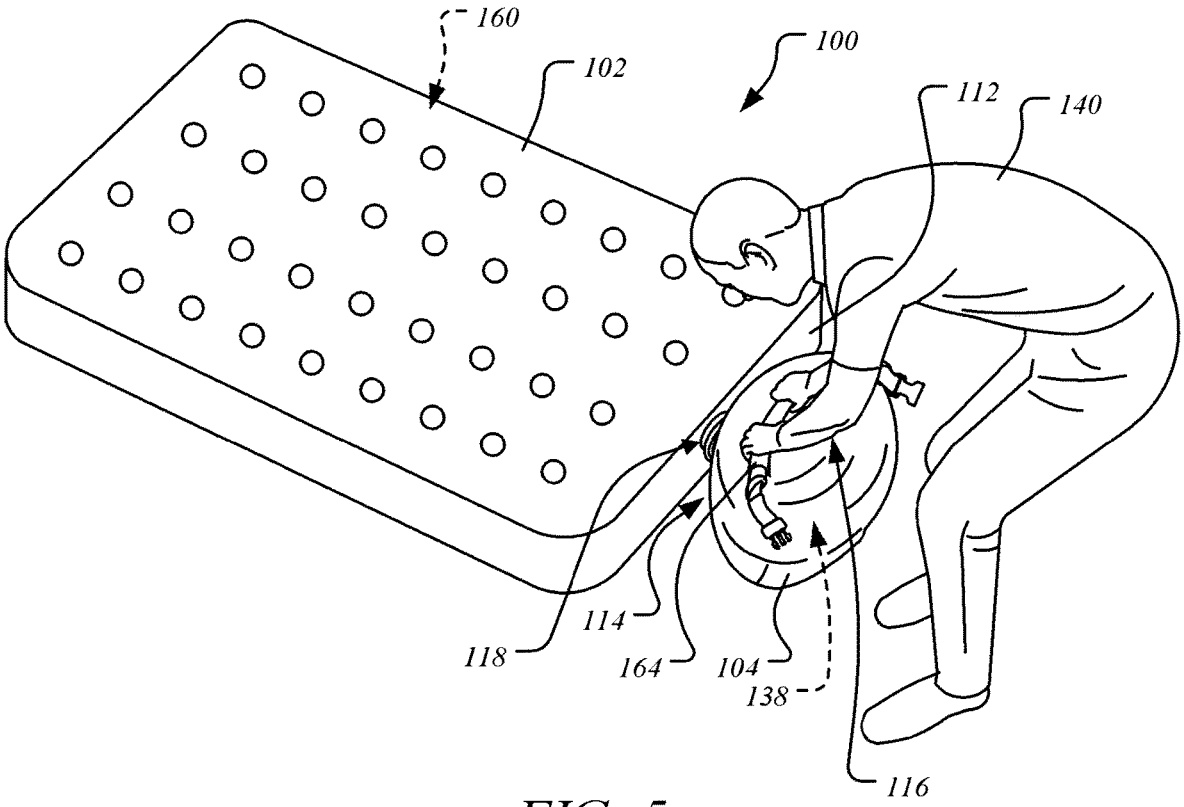
FIG. 5 is an isometric view from above of the system for inflating and inflatable shown in FIG. 1 with the inflating bladder being operated by the user.

Referring now to FIGS. 4 and 5, operation of the inflating bladder 104 is illustrated. A spring and/or closing mechanism 132 opens and closes the air intake end 116. When the air intake end 116 is open, air enters the inflating bladder 104. Then the closing mechanism 132 operates to seal the air intake end 116 thereby capturing air within the inflating bladder 104. The spring and/or closing mechanism 132 may be a magnet, reusable adhesive, leaf spring, taper spring, torsion spring, flat spring, elastic material, or any other suitable mechanism for holding together the material of the inflating bladder 104 at the air intake end 116. In the example embodiment illustrated in FIG. 4, first and second magnetic strips 134*a*, 134*b* are disposed along first and second edges 136*a*, 136*b* of the air intake end 116 of the inflating bladder 104. The first and second magnetic strips 134*a*, 134*b* are of opposite polarization and have a moderate magnetic attraction to one another. The magnetic attraction snaps the strips together and in alignment thereby bringing together the first and second edges 136*a*, 136*b*. Thus, the first and second magnetic strips 134*a*, 134*b* hold the first and second edges 136*a*, 136*b* together loosely sealing the air intake end 116 and, thus, capturing air within an interior compartment 13 8 of the inflating bladder 104. Further, the resilience of the spring and/or closing mechanism 132 may be varied in order to increase the seal created thereby or increase ease of use, as desirable.

In alternative example embodiments, the closing mechanism 132 may be a spring 162 (FIG. 1) or other suitably resilient component. The spring 162 may be of one or more pieces disposed on or within the first and second edges 136*a*, 136*b* of the air intake end 116 of the inflating bladder. The first and second edges 136*a*, 136*b* may also be a single continuous edge with an elongate spring disposed thereal-ong. The spring 162 may have a first, natural position corresponding to a closed configuration of the air intake end 116 of the inflating bladder 104. In this example embodiment, the spring 162 may be opened to allow air to enter the inflating bladder 104, subsequently snapping back to the first, natural position, closing the air intake end 116, and capturing air within the inflating bladder 104. In example embodiments, the resiliency of the spring 162.

As shown in FIG. 4, magnetic strips 134*a*, 134*b* do not need to create an airtight or strong seal, although the magnetic strips 134*a*, 134*b* may produce such a seal, between the first and second edges 136*a*, 136*b*. Instead, a user 140 performs a rolling and/or folding maneuver on material of the inflating bladder 104 beginning at the air intake end 116. During the rolling and/or folding maneuver, for example, the user 140 may use a twisting motion to fold and/or wrap the material of the inflating bladder 104 about the held together and aligned first and second magnetic strips 134*a*, 134*b*. The rolling and/folding of the material creates a seal that is substantially art tight. Consequently, the seal created does not need to prevent all leakage of air to be effective and so air-tightness is not required of said seal. Instead, the rolling and/or folding maneuver creates a seal sufficient to force air through the air passageway 122 of the connector 118 and further through the one-way inflation valve 126. To continue forcing air out of the inflating bladder 104, the user 140 may continue to fold and/or roll the fabric of the inflating bladder 104 or the user 140 may perform other motions in addition to rolling and/or folding including, but not limited to, smashing, pushing, stepping on, and/or squeezing in order to force additional air out of the inflating bladder 104 and into the inflatable 102. Further, once an amount of the flexible fabric of the inflating bladder 104 is rolled/folded over the magnetic strips 134*a*, 134*b* and/or spring 162, the folded material forms a handle 164. The handle 164 may aids the user 140 in performing a pumping motion with the inflating bladder 104 by grasping the handling and pushing the inflating bladder 104 towards the air-exiting end 114 of the inflating bladder 104.

Upon forcing an amount of air from the inflating bladder 104, the user 140 may unroll and/or unfold the inflating bladder 104. Then the user 140 separates the first and second magnetic strips 134*a*, 134*b* thereby opening the relatively large air intake end 116 and allowing air to fill the inflating bladder 104 once again. Next, the user 140 may reseal the air intake end 116 by bringing the first and second magnetic strips 134*a*, 134*b* into proximity with one another to re-seal the inflating bladder 104. The user 140 may repeat the opening, filling, sealing, and rolling/folding steps as necessary to adequately fill the inflatable 102.

In example embodiments of the system 100 described hereinabove, the inflating bladder 104 may also serve as a bag for carrying the inflatable 102. For example, it may be possible to fold up an inflatable mattress for insertion into the inflating bladder 104 for storage and transport thereof. (See FIG. 1B). Further, the inflating bladder 104 may have an alternative use as a pillow. Following inflation of the inflatable 102 in accordance with the above description, the inflating bladder 104 may be filled with air and sealed. Then the magnetic strips 134*a*, 134*b* of the inflating bladder 104 may be folded over once or more before first and second clips 152*a*, 152*b* attached to first and second nylon straps 154*a*, 154*b* are clipped together holding the folded portion of the inflating bladder 104 in the sealed position. The inflated bladder 104 may then be used as a pillow in conjunction with the inflatable 102. To facilitate use of the inflating bladder 104 as a pillow, a cap may be applied to the male portion 106 of the connector 118, thereby sealing the inflating bladder 104 on the air outlet end 114 thereof, rather than allowing air to be push through the passageway 122 of the male connecting portion 106, as is the case during the inflation operation described hereinabove. In another example embodiment, the inflatable 102 may further include a dump valve disposed separately from or alongside the inflation valve 126. The dump valve allows for rapid release of air during deflation of the inflatable 102, such as for storage or transport thereof.

INDUSTRIAL APPLICABILITY

The above disclosure may represent an improvement in the art because it allows for use of the inflatable without a pump and without the laborious task of lung-powered inflation. Further, this disclosure provides the user with improved storage and transport of the inflatable within the inflating bladder while doing away with the storage and transport of pumps and/or associated power sources. Still further, the disclosure improves the art by supplying an alternative use for the inflating bladder as a pillow.

It is to be understood that all described elements and features in this disclosure can be formed of any number of materials including, but not limited to, polymers, rubbers, foams, ceramics, metals, metal alloys or any other material known to those skilled in the art. In particular, the material forming the inflating bladder 104 and/or inflatable 102 may be plastic, vinyl, coated fabric, and/or another suitable material or combination of materials. The valve system 110 and the connector 118 may be formed from extruded plastic, machined aluminum, another metal alloy, and/or another materials or combination of materials suitable for manufacturing the components of the valve 110.

While some implementations have been illustrated and described, numerous modifications come to mind without significantly departing from the spirit of the disclosure, and the scope of protection is only limited by the scope of the accompanying claims.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

I claim:

1. An inflatable air mattress system comprising:

an inflatable air mattress defining an air chamber, the inflatable air mattress comprising:

an inflation valve defining an inlet passageway in communication with the air chamber, the inflation valve comprising a first connector, a seal movable between a closed position blocking the inlet passageway and an open position in which the inlet an inflating bladder comprising:

a at least one wall of flexible fabric defining an interior portion extending between a first end of the bladder and a second end of the bladder, a closing spring attached to the first end of the bladder, and a second connector abashed to the second end of the bladder and configured such that the second connector connects to the first connector, wherein the closing spring comprises one or more flat magnets.

2. A method of inflation of an inflatable air chamber, the method comprising:

coupling a first end of an inflating bladder to the inflatable air chamber via a valve connector, opening a second end of the inflating bladder;

sealing the second end of the inflating bladder by moving two magnets proximal one another such that the two magnets snap together, thereby capturing air within the inflating bladder;

folding the second end of the inflating bladder toward the valve connector, thereby forcing air through the valve connector and into the inflatable air chamber.

3. An inflation system comprising:

an inflatable air chamber, an inflating bladder comprising, a first end detachably coupled to the inflatable air chamber, a second end comprising:

an air passage opening and a closing spring comprising a first magnetic strip configured such that the first magnetic strip connects to a second magnetic strip and thereby closes the air passage opening, thereby capturing air within the inflating bladder.

4. The inflation system of claim 3, wherein the inflating bladder comprises a flexible fabric defining an interior air chamber.

* * * * *